United States Patent [19]

Hsiao

[11] 4,455,992

[45] Jun. 26, 1984

[54] FOLDING ROASTER

[76] Inventor: Chin-Wen Hsiao, No. 16, Alley 2, Lane 384, She-Chung St., Shih-Lin, Taipei, Taiwan

[21] Appl. No.: 437,758

[22] Filed: Feb. 15, 1983

[51] Int. Cl.[3] ..... F24C 1/16

[52] U.S. Cl. ..... 126/9 R

[58] Field of Search ..... 126/9 B, 9 R, 275 R, 126/29, 30

[56] References Cited

U.S. PATENT DOCUMENTS

| | | | |
|---|---|---|---|
| 2,244,935 | 1/1941 | Binger | 126/9 R |
| 3,667,446 | 6/1972 | Morton | 126/9 R |
| 4,149,514 | 4/1979 | Latouf | 126/9 R |

FOREIGN PATENT DOCUMENTS

| | | | |
|---|---|---|---|
| 40612 | 6/1973 | Sweden | 126/30 |

*Primary Examiner*—Samuel Scott
*Assistant Examiner*—G. Anderson

[57] ABSTRACT

A folding roaster comprises a front trapezoid plate, a rear trapezoid plate, two folding side plates, an uppermost screen, a middle screen and a lower screen or bottom ash pan in that all plates are developed for putting screens on the roaster and the uppermost screen is put on the top edges of the plate for roasting use, the middle screen is put on the middle portion for supporting burning charcoal and the lower screen is put on the lower portion for supporting burning wood thereon.

1 Claim, 4 Drawing Figures

FOLDING ROASTER

BACKGROUND OF THE INVENTION

The conventional roaster is generally made from cast iron in which charcoal is burned to roast meat for barbecue use. However, such a cast-iron roaster is heavy and inconveniently handled especially when used outdoors.

The present invention has overcome this defect of conventional roaster and invented the present folding roaster.

SUMMARY OF THE INVENTION

The object of the present invention is to provide a folding roaster comprising a front trapezoid plate, a rear trapezoid plate, two folding side plates, an uppermost screen, a middle screen, a lower screen and a bottom ash pan in that the trapezoid plates and side plates are developed for putting screens on the roaster. The uppermost screen is put on the top edges of the roaster for roasting use; the middle screen is put in the middle portion of the roaster for supporting burning charcoal; the lower screen is put on the lower portion of the roaster for supporting burning wood and the bottom ash pan serves to collect the burned ash either from charcoal or wood,

DETAILED DESCRIPTION

Figure 1:
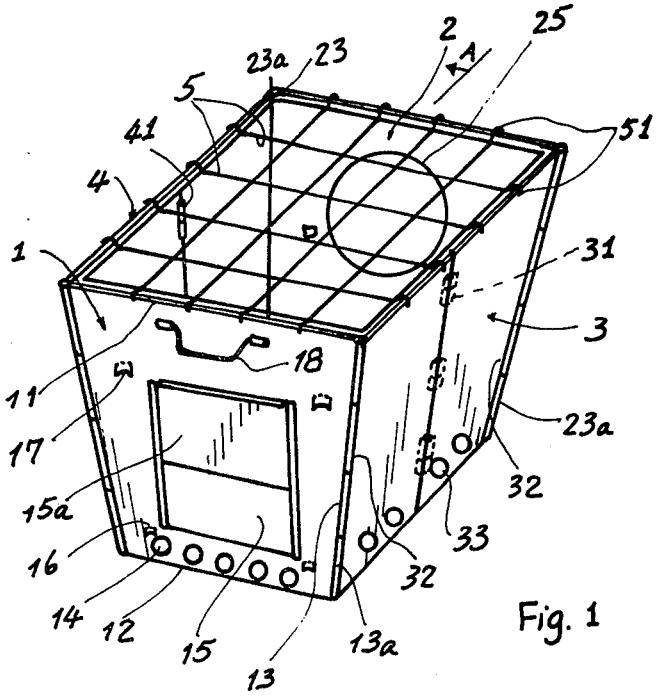
FIG. 1 is a perspective drawing of the present invention.

As shown in the figures, the present invention comprises a front trapezoid plate 1, a rear trapezoid plate 2, two folding side plates 3,4, an uppermost screen 5, a middle screen 6, a lower screen 7 and a bottom ash pan 8.

The front trapezoid plate 1 is formed as a trapezium by a longer top edge 11, a shorter bottom edge 12 and two side edges 13. A plurality of bottom holes 14 are formed on the lower portion near the bottom edge 12 of plate 1. A main air hole 15 is formed above the bottom holes 14 to lead combustion air into the present roaster, which is adjusted for its opening by a door 15*a* formed thereon. Two lower brackets 16 are formed on the plate 1 and extend inside plate 1 to support the lower screen 7. Two upper brackets 17 are formed on plate 1 and extend inside to support middle screen 6. A handle 18 is pivotedly formed on plate 1 for portable use. Side edge 13 is pivotedly coupled with side edge 32 of side plate 3 or 4 by hinge 13*a*.

The rear trapezoid plate 2 is also formed as a trapezium equivalent to plate 1 by comprising a top edge 21, a bottom edge 22 and two side edges 23. A plurality of bottom holes 24 are formed near the bottom edge 22. An air draft hole 25 is formed near the top edge 21 to vent combustion gases therefrom. Two lower brackets 26 are formed on plate 2 to support lower screen 7 and two upper brackets 27 are formed thereon to support middle screen 6. A handle 28 is pivotedly formed thereon for portable use.

Each of the two side plates 3, 4 comprises a central hinge 31 or 41 centrally formed thereon and two side edges 32 or 42 each coupled with side edge 13 and side edge 23 respectively by hinges 13*a*, 23*a*. A plurality of bottom holes 33 or 43 are formed near the bottom edge of plate 3 or 4.

When utilizing the present invention, the four plates 1, 2, 3, 4 are developed as FIG. 1 shown. Uppermost screen 5, including extending hooks 51 terminated from each wire of screen 5, is put on the top edges thereof from roasting meat or foods. Middle screen 6 is put on upper brackets 17, 27 for supporting burning charcoal. The lower brackets 16, 26 serves to support an ash pan 8 when roasted with charcoal.

Figure 2:
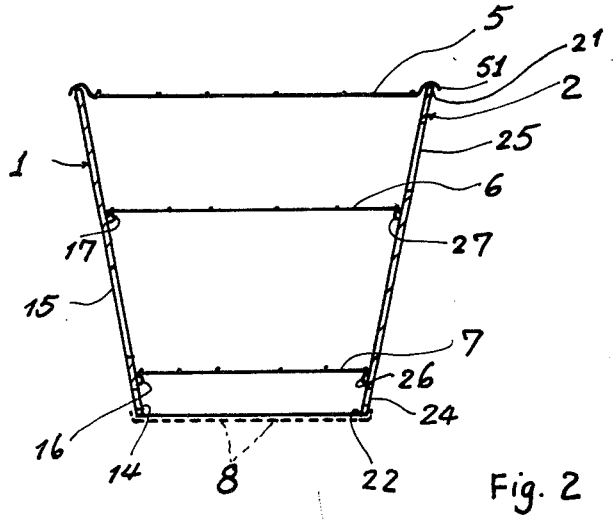
FIG. 2 is a sectional drawing taken from direction A of FIG. 1.

However, when roasted with burning wood which is put on lower screen 7 supported by lower brackets 16, 26, the ash pan 8 can be embedded under the present roaster as dotted line shown in FIG. 2.

Figure 3:
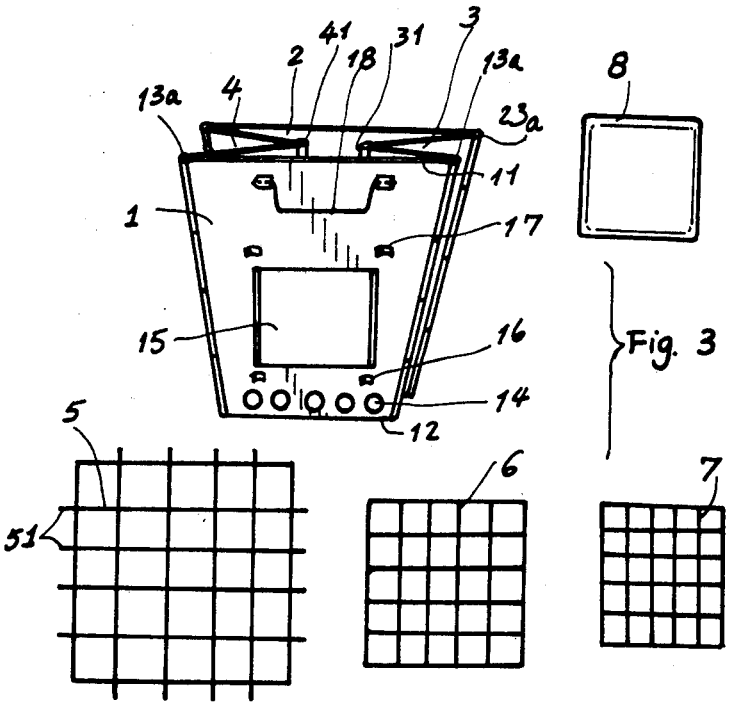
FIG. 3 is an illustration showing the folding operation of the present invention.
Figure 4:
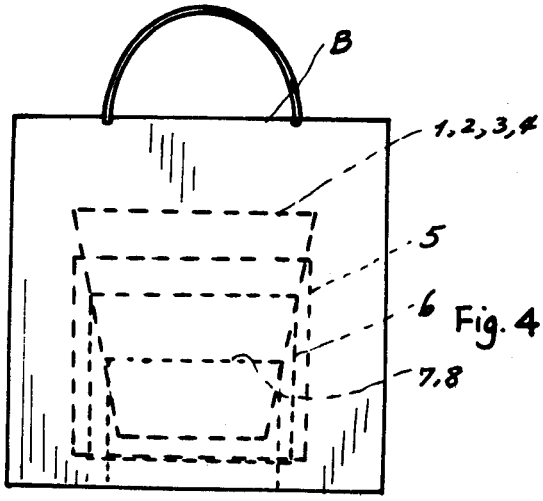
FIG. 4 shows the present invention packed into a bag.

When the present invention is not in use, it can be folded as FIG. 3 shown in which the central hinges 31, 41 are folded to overlap plate 1 on plate 2 to reduce its volume to a minimum one for packing use as stored in a bag B as FIG. 4 shown for convenient handling or storage.

All plates 1, 2, 3, 4 can be made from tin plate or aluminum plate to be light during handling. The uppermost screen 5 may also be substituted with a drying pan (not shown) for frying or cooking foods.

I claim:

1. A folding roaster comprising:

a front trapezoid plate having a main air inlet hole, a rear trapezoid plate having an air draft hole, two folding side plates, an uppermost screen, a middle screen, a lower screen and a bottom ash pan, in that said front trapezoid plate, said rear trapezoid plate and two folding side plates being developed for putting the screens on the roaster, said uppermost screen being put on the top edges of roaster for roasting use, said middle screen being put on the middle portion of roaster for supporting burning charcoal, said lower screen being put on the lower portion of roaster for supporting burning wood, and said bottom ash pan being put on the lower portion of roaster or under the roaster for collecting ash;

the improvement which comprises:

a front trapezoid plate comprising a longer top edge, a shorter bottom edge and two side edges to form a trapezium which is pivotedly coupled with each said folding side plate by a hinge, said front trapezoid plate being formed with a plurality of bottom holes near the bottom edge thereof for leading combustion air into roaster;

a rear trapezoid plate comprising a longer top edge, a shorter bottom edge and two side edges to form a trapezium which is pivotedly coupled with each said folding side plate by a hinge, said rear plate being formed with a plurality of bottom holes near the bottom edge of the plate;

said front and rear trapezoid plate which are each formed with two lower brackets to support said lower screen or bottom ash pan, and each formed with two upper brackets to support said middle screen, and pivotedly formed with two handles for portable use; and two folding side plates each comprising a central hinge which can be folded to collapse the roaster, two side edges each pivotedly coupled with said front trapezoid plate and said rear trapezoid plate respectively by two hinges, and a plurality of bottom holes formed near the bottom edge.

* * * * *